US009130321B2

(12) United States Patent
Chang et al.

(10) Patent No.: US 9,130,321 B2
(45) Date of Patent: Sep. 8, 2015

(54) ELECTRICAL CONNECTOR HAVING CONTACT FOR EITHER BGA OR LGA PACKAGE

(71) Applicant: HON HAI PRECISION INDUSTRY CO., LTD., New Taipei (TW)

(72) Inventors: Yen-Chih Chang, New Taipei (TW); Wei-Hung Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 240 days.

(21) Appl. No.: 13/854,946

(22) Filed: Apr. 1, 2013

(65) Prior Publication Data

US 2013/0267104 A1 Oct. 10, 2013

(30) Foreign Application Priority Data

Apr. 9, 2012 (TW) ..... 101206330 A

(51) Int. Cl.
*H01R 12/00* (2006.01)
*H01R 12/71* (2011.01)

(52) U.S. Cl.
CPC ..... *H01R 12/712* (2013.01); *H01R 12/716* (2013.01)

(58) Field of Classification Search
CPC ..... H05K 7/1069
USPC ..... 439/71, 70
See application file for complete search history.

(56) References Cited

U.S. PATENT DOCUMENTS

| | | | | | |
|---|---|---|---|---|---|
| 3,717,322 | A * | 2/1973 | Bernard | 251/61 |
| 5,641,945 | A * | 6/1997 | Abe et al. | 174/261 |
| 5,802,699 | A * | 9/1998 | Fjelstad et al. | 29/593 |
| 6,069,481 | A * | 5/2000 | Matsumura | 324/756.02 |
| 6,142,792 | A * | 11/2000 | Yang | 439/70 |
| 6,224,396 | B1 * | 5/2001 | Chan et al. | 439/71 |
| 6,409,521 | B1 * | 6/2002 | Rathburn | 439/66 |
| 6,426,553 | B2 * | 7/2002 | Inomata | 257/727 |
| 6,535,002 | B2 * | 3/2003 | Haseyama et al. | 324/756.02 |
| 6,958,616 | B1 * | 10/2005 | Mahoney et al. | 324/755.05 |
| 6,981,881 | B2 * | 1/2006 | Adachi et al. | 439/71 |
| 7,045,889 | B2 * | 5/2006 | Canella | 257/698 |
| 7,097,463 | B2 | 8/2006 | Hsiao et al. | |
| 7,202,686 | B2 * | 4/2007 | Sakiyama | 324/756.02 |
| 7,471,096 | B2 * | 12/2008 | Kohashi et al. | 324/754.09 |
| 7,534,113 | B2 | 5/2009 | Liao et al. | |
| 8,033,877 | B2 * | 10/2011 | Di Stefano | 439/851 |
| 8,044,502 | B2 * | 10/2011 | Rathburn | 257/692 |
| 8,441,275 | B1 * | 5/2013 | Alladio | 324/756.02 |

* cited by examiner

*Primary Examiner* — Neil Abrams
(74) *Attorney, Agent, or Firm* — Wei Te Chung; Ming Chieh Chang

(57) ABSTRACT

An electrical connector for electrically connecting an IC package to a circuit board includes an insulating housing having a plurality of receiving holes and a plurality of contacts received in the receiving holes. Each of the contacts includes a retaining portion engaging with the insulating housing, and a spring arm deforming freely in a certain range, wherein the spring arm includes an elastic deformation portion, a recess portion protruding downwardly from the elastic deformation portion for contacting with a ball grid array (BGA) package and a protrusion portion protruding upwardly from the recess portion for contacting with a land gird array (LGA) package.

20 Claims, 7 Drawing Sheets

ELECTRICAL CONNECTOR HAVING CONTACT FOR EITHER BGA OR LGA PACKAGE

BACKGROUND OF THE INVENTION

1. Field of the Invention

The present disclosure relates to an electrical connector for connecting an IC package with a circuit board, and particularly to an electrical connector having low profile contact for either ball gird array (BGA) package or land grid array (LGA) package.

2. Description of Related Art

At present, electrical connector is widely used to electrically connect central processing unit (CPU) with printed circuit board (PCB). According to the difference of the terminals in the CPU, the CPU can be classified as pin gird array (PGA) package, ball gird array (BGA) package and land grid array (LGA) package. The PGA package has a number of pins disposed on a bottom surface of the package, the BGA package has a number of solder balls disposed thereon while the LGA package has a number of pads disposed thereon. Corresponding to different types of package, the electrical connectors have different contacts for contacting the package.

U.S. Pat. No. 7,097,463 issued to Hsiao, et al. on Aug. 29, 2006 discloses a related electrical connector for connecting a BGA package to a PCB. The electrical connector comprises an insulating housing and a number of contacts received in the insulating housing. Each of the contacts comprises a connecting portion, a solder pad extending from a bottom end of the connecting portion, and a cantilever extending aslant from a top end of the connecting portion. The cantilever has a concave portion near a free end thereof. When the BGA package with a multiplicity of solder balls is attached onto the connector, the concave portions of the contacts cover bottom portions of the solder balls. Therefore, a reliable connection between the BGA package and the PCB is established.

U.S. Pat. No. 7,534,113 issued to Liao, et al. on May 19, 2009 discloses a contact for LGA package. The contact comprises a retention portion, a spring arm extending above the retention portion and a tail portion extending downwardly from the retention portion. The spring arm comprises a contacting portion for contacting the LGA package, and the tail portion is used to be soldered on a PCB so that an electrical connection can be established therebetween.

However, each of the contacts mentioned above can just be used into one determined type of CPU only. When contacting the other type of CPU, the electrical connector can not be used any more, another electrical connector must be needed which result in much more additional costs.

In view of the above, an improved electrical connector is desired to overcome the problems mentioned above.

SUMMARY OF THE INVENTION

Accordingly, an object of the present disclosure is to provide an electrical connector having low profile contacts for either BGA package or LGA package.

According to one aspect of the present disclosure, an electrical connector for electrically connecting an IC package to a printed circuit board comprising an insulating housing and a plurality of contacts received in the insulating housing. The insulating housing comprises a top surface, a bottom surface, and a plurality of receiving holes running through the top surface and the bottom surface. The contact received in the receiving hole comprises a retaining portion engaging with the insulating housing, and a spring arm deforming freely in a certain range, wherein the spring arm comprises an elastic deformation portion, a recess portion protruding downwardly from the elastic deformation portion for contacting with a ball grid array (BGA) package and a protrusion portion protruding upwardly from the recess portion for contacting with a land gird array (LGA) package.

Other objects, advantages and novel features of the disclosure will become more apparent from the following detailed description when taken in conjunction with the accompanying drawings, in which:

DETAILED DESCRIPTION OF THE INVENTION

Figure 1:
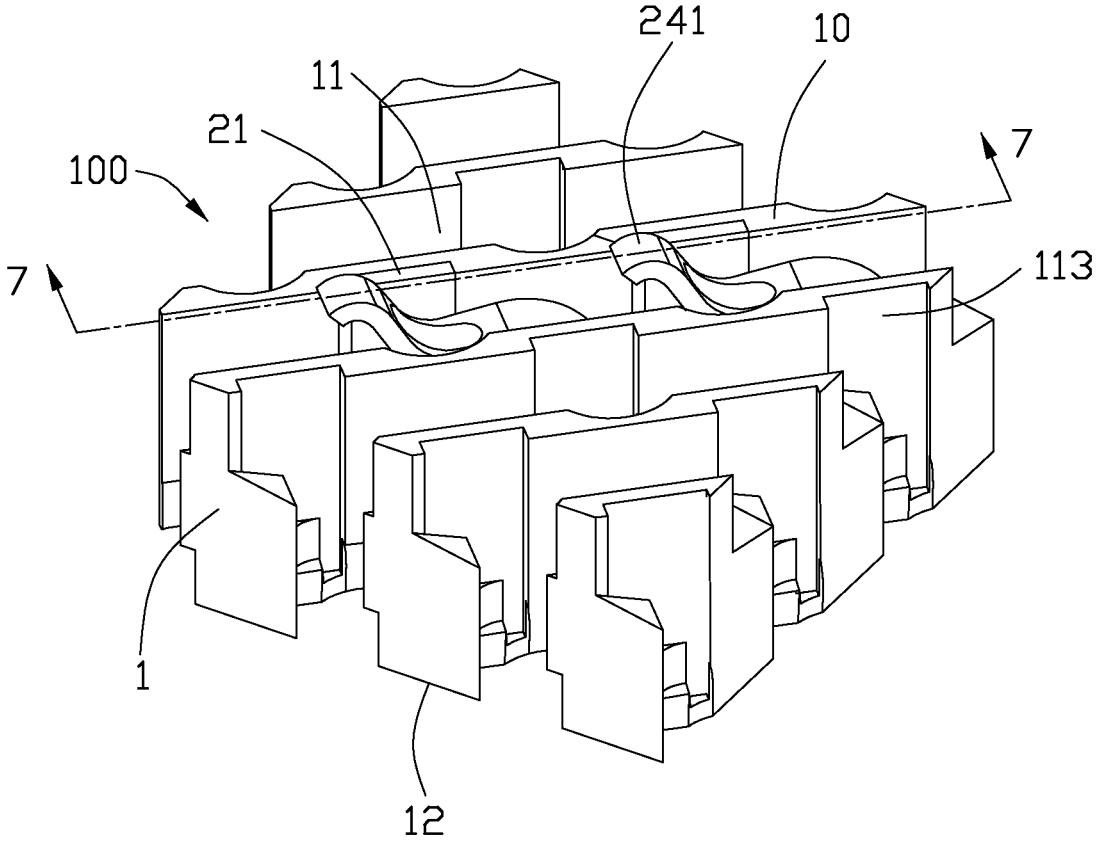
FIG. 1 is an assembled, perspective view of an electrical connector in accordance with a preferred embodiment of the present disclosure.

Reference will now be made to the drawings to describe the present disclosure in detail.

Referring to FIG. 1 to FIG. 7, an electrical connector 100 for electrically connecting a LGA package 4 or a BGA package 5 to a printed circuit board (not shown) includes an insulating housing 1 with a plurality of receiving holes 11, a plurality of contacts 2 retained in the receiving holes 11, and a plurality of solder balls 3 for soldering the contacts 2 on the printed circuit board.

Figure 3:
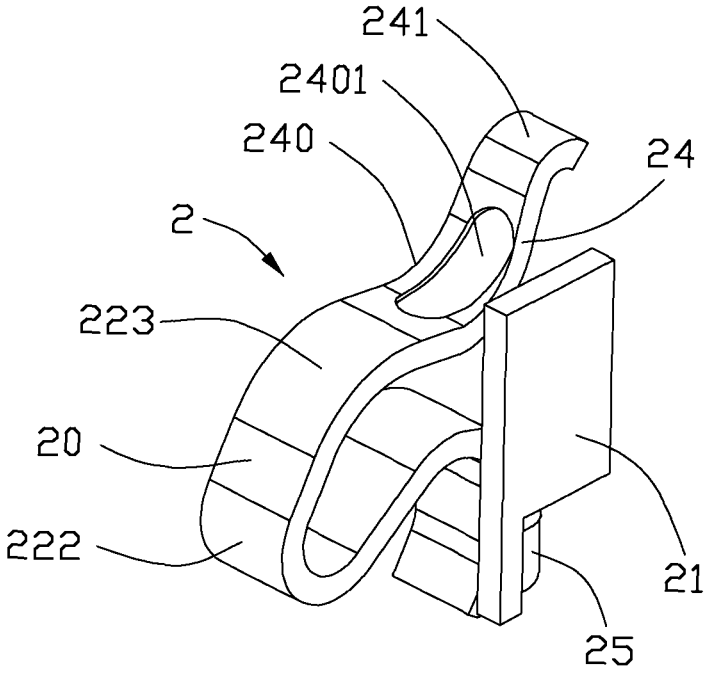
FIG. 3 is a perspective view of the contact shown in FIG. 1.
Figure 4:
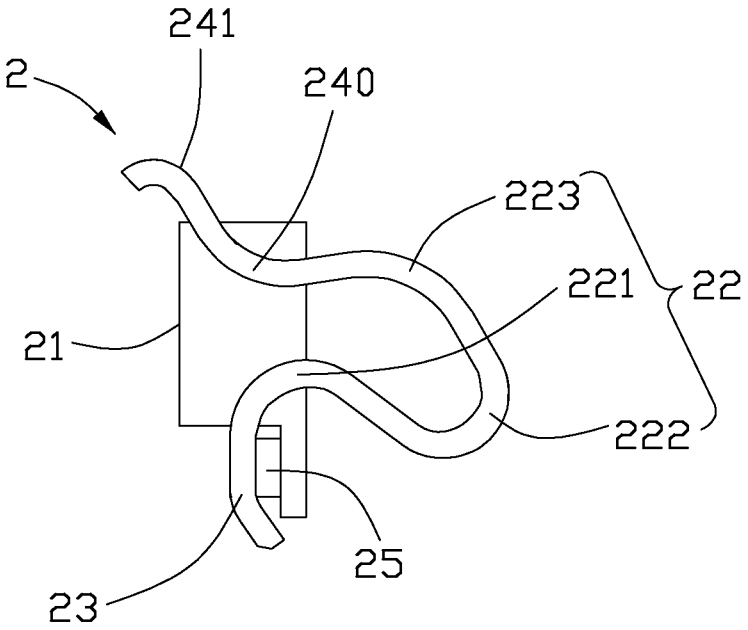
FIG. 4 is a side view of the contact shown in FIG. 3.
Figure 5:
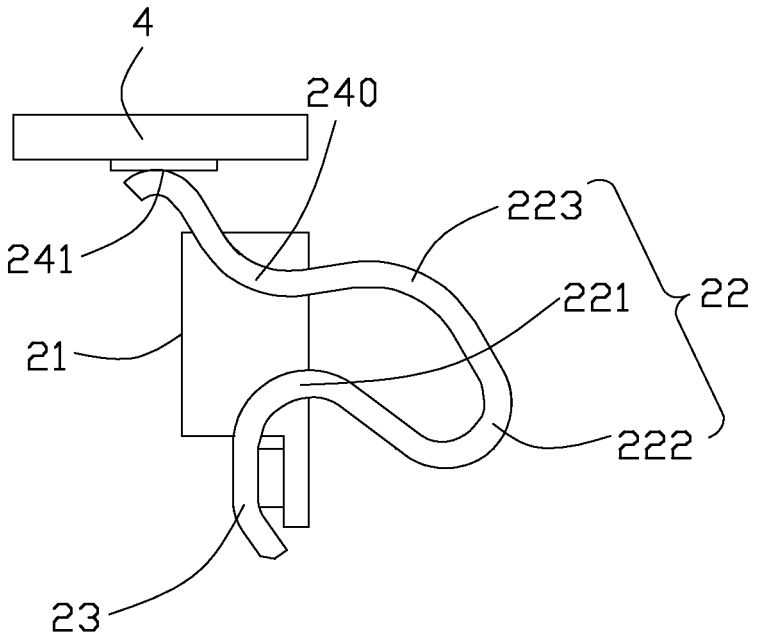
FIG. 5 is a view similar to FIG. 4, wherein the contact connects a LGA package.
Figure 6:
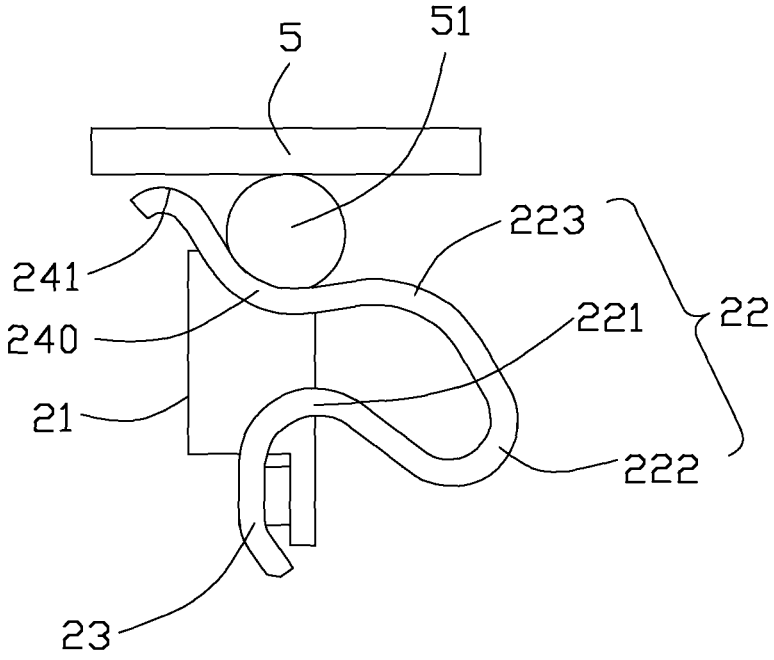
FIG. 6 is a view similar to FIG. 4, wherein the contact connects a BGA package.
Figure 7:
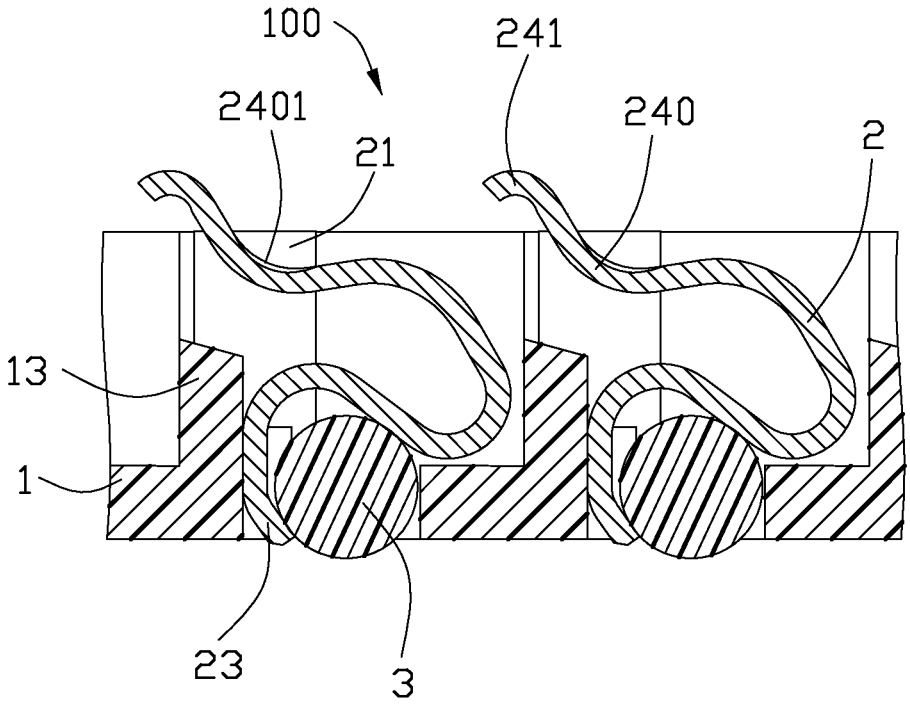
FIG. 7 is a sectional view of the electrical connector shown in FIG. 1 along line 7-7.

Referring to FIG. 3 and FIG. 4, the contact 2 comprises a base portion 23, a connecting portion 25 bending from one side of the base portion 23, a retaining portion 21 connecting with the base portion 23 by the connecting portion 25, and a spring arm 20 extending from an upper end of the base portion 23. At a lower end of the base portion 23, a tail (not labeled) is defined thereon for clamping the solder ball 3. The connecting portion 25 is bent 90 degree from one side of the base portion 23, and connects one side of the retaining portion 21.

The spring arm 20 comprises an elastic deformation portion 22 and a contacting portion 24. The contacting portion 24 comprises a recess portion 240 protruding downwardly from an end of the elastic deformation portion 22, and a protrusion portion 241 protruding upwardly from the recess portion 240. The elastic deformation portion 22 comprises a first curved section 221 extending obliquely and upwardly from the upper end of the base portion 23 and then bending downwardly, a second curved section 222 extending obliquely and downwardly from the first curved section 221 and then bending upwardly and backwardly, and a third curved section 223 extending obliquely and upwardly from the second curved section 222. The recess portion 240 is formed by extending obliquely and downwardly from the third curved section 223 and then extending upwardly. The recess portion 240 comprises a notch 2401 configured with an arc-shaped profile similar to a bottom profile of a ball 51 on the BGA package 5 for connecting the ball 51 reliably. The surface of the notch 2401 is a rough surface for wiping the dirt or the oxide layer from the ball 51. In free state, the recess portion 240 locates upon the upper end of the base portion 23 in a vertical direction and below the upper end of the retaining portion 21 while the protrusion portion 241 locates above the upper end of the retaining portion 21. In the direction perpendicular to the retaining portion 21, the projection of the recess portion 240 locates on the retaining portion 21.

Figure 2:
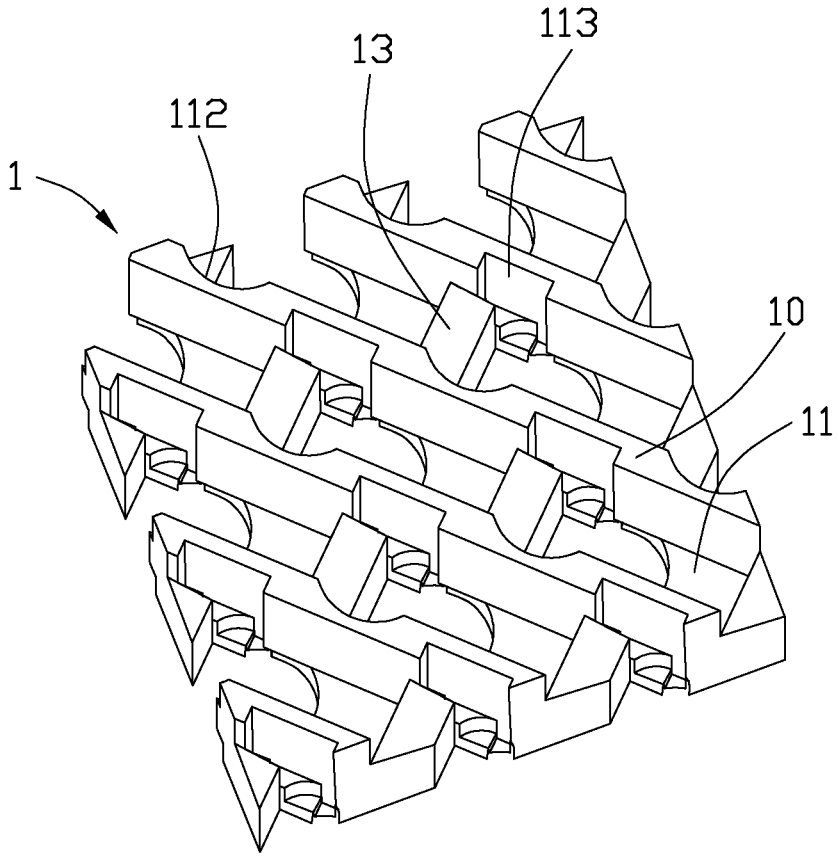
FIG. 2 is a perspective view of the insulating housing shown in FIG. 1.

Referring to FIG. 1 and FIG. 2, the insulating housing 1 comprises a top surface 10, a bottom surface 12 opposite to the top surface 10, and a plurality of receiving holes 11 running through therebetween. The receiving hole 11 comprises two opposite side walls, one of the side walls comprises a retaining slot 113 for receiving the retaining portion 21, the other side wall comprises a cylindrical depression 112 for receiving the ball 51 of the BGA package 5. The insulating housing 1 further comprises a plurality of embosses 13 located in the receiving hole 11 and under the recess portion 240 for supporting the recess portion 240 when the contact 2 is press down. The electrical connector 100 further comprises a plurality of solder balls 3. The tail of the base portion 23 together with the insulating housing 1 clamps the solder balls 3 therein.

In assembly, the contact 2 is assembled in the receiving hole 11 from the top surface 10 to the bottom surface 12, the retaining portion 21 received in the receiving slot 113, the recess portion 240 below the top surface 10 of the insulating housing 1 while the protrusion portion 241 extending above the top surface 10 of the insulating housing 1. Then, the solder ball 3 is assembled in the receiving hole 11 from the bottom surface 12 to the top surface 10 and retained therein by the contact 2 and the insulating housing 1.

According to the above described embodiment of the present disclosure, an electrical connector 100 with low profile contacts 2 for either BGA or LGA package is provided. The contact 2 comprises a recess portion 240 for contacting the ball 51 of the BGA package 5 and a protrusion portion 241 for contacting the pad of the LGA package 4. Therefore, the electrical connector 100 can be used in two types of package which result in cost down.

While preferred embodiments in accordance with the present disclosure has been shown and described, equivalent modifications and changes known to persons skilled in the art according to the spirit of the present disclosure are considered within the scope of the present disclosure as defined in the appended claims.

What is claimed is:

1. An electrical connector for electrically connecting an IC package to a printed circuit board comprising:

an insulating housing having a top surface and a bottom surface opposite to each other in a vertical direction, and a plurality of receiving holes running through the top surface and the bottom surface; and a plurality of contacts received in the receiving holes each comprising a retaining portion retained in the insulating housing, and a spring arm deforming freely in a certain range; wherein the spring arm comprises an elastic deformation portion, a recess portion protruding downwardly from an end of the elastic deformation portion for contacting with a ball grid array (BGA) package and a protrusion portion protruding upwardly from the recess portion for contacting with a land gird array (LGA) package; wherein the recess portion is located beside the retaining portion in a transverse direction perpendicular to said vertical direction.

2. The electrical connector as claimed in claim 1, wherein the protrusion portion extending above the top surface of the insulating housing while the recess portion below the top surface of the insulating housing.

3. The electrical connector as claimed in claim 1, wherein the elastic deformation portion comprises a first curved section extending obliquely and upwardly and then bending downwardly, a second curved section extending obliquely and downwardly from the first curved section and then bending upwardly and backwardly, and a third curved section extending obliquely and upwardly from the second curved section.

4. The electrical connector as claimed in claim 3, wherein the recess portion protruding downwardly from the third curved section.

5. The electrical connector as claimed in claim 3, wherein the contact comprises a base portion, the first curved section extending upwardly from an upper end of the base portion.

6. The electrical connector as claimed in claim 5, wherein the retaining portion connects one side of the base portion by a connecting portion configured with a right angle.

7. The electrical connector as claimed in claim 1, wherein the recess portion further comprises a notch configured with an arc-shaped profile similar to the bottom profile of a ball on the BGA package.

8. The electrical connector as claimed in claim 1, wherein the insulating housing comprises an emboss located in the receiving hole and under the recess portion for supporting the recess portion when the contact is press down.

9. An electrical connector for electrically connecting an IC package to a printed circuit board comprising:

an insulating housing having a plurality of receiving holes; and a plurality of contacts received in the receiving holes respectively, each comprising a base portion and a spring arm extending from an upper end of the base portion; wherein the spring arm comprises an elastic deformation portion extending one side of the base portion and a contacting portion further extending towards the base portion from an end of the elastic deformation portion; and wherein the contacting portion comprises a recess portion for contacting with a ball of a BGA package and a protrusion portion extending from the recess portion and protruding another side of the base portion, the recess portion is arranged upon the upper end of the base portion in a vertical direction;

wherein the recess portion further comprises a through notch configured with an arc-shaped profile similar to a bottom profile of the ball.

10. The electrical connector as claimed in claim 9, wherein the elastic deformation portion comprises a first curved section extending obliquely and upwardly from the upper end of the base portion and then bending downwardly, a second curved section further extending obliquely and downwardly from the first curved section and then bending upwardly and backwardly, and a third curved section extending obliquely and upwardly from the second curved section.

11. The electrical connector as claimed in claim 9, wherein the protrusion portion does not contact the ball when a stable connection established between the contact and the ball of the BGA package.

12. The electrical connector as claimed in claim 9, wherein the top point of the ball is higher than the protrusion portion in the vertical direction.

13. An electrical connector comprising:

an insulative housing defining a plurality of receiving holes upward facing toward an exterior through an upper surface thereof in a vertical direction;

a plurality of contacts disposed in the corresponding receiving holes, respectively, each of said contacts defining an LGA (Land Grid Array) type contacting section, for use with an LGA type electronic package, and a BGA (Ball Grid Array) type contacting section, for use with a BGA type electronic package, side by side with each other; wherein said LGA type contacting section is higher than the BGA type contacting section; wherein said LGA type contacting section is located above the upper surface while said BGA type contacting section is essentially located below the upper surface in the vertical direction; wherein the contact defines a base portion, an elastic deformation portion extending from the base portion, and the BGA type contacting section extends from the elastic deformation portion while the LGA type contacting section extends from the BGA type contacting section; wherein all the elastic deformation portion, the BGA contacting section and the LGA contacting sections are fully exposed in an open air.

14. The electrical connector as claimed in claim 13, wherein each of said receiving hole is equipped with a cylindrical recess for compliance with a solder ball of the BGA type electronic package.

15. The electrical connector as claimed in claim 13, wherein the BGA type contacting section is essentially aligned with and located right above the base portion in said vertical direction.

16. The electrical connector as claimed in claim 13, wherein said elastic deformation portion includes a downward first curved section, an upward second curved section beside the first curved section in a lateral direction, and a downward third curved section located above both said first curved section and said second curved section.

17. The electrical connector as claimed in claim 13, wherein said BGA type contacting section is essentially a recess portion with therein a through notch configured with an arc-shaped profile similar to a bottom profile of a ball of said BGA type electronic package.

18. The electrical connector as claimed in claim 13, wherein the contact includes a retaining portion located beside the base portion, the elastic deformation portion, the BGA contacting section and the LGA contacting section, in a transverse direction perpendicular to said vertical direction.

19. The electrical connector as claimed in claim 18, wherein the BGA type contacting section is essentially aligned with and located right above the base portion in a vertical direction, and the elastic deformation portion and the LGA contacting section are located by two sides of the retaining portion in a lateral direction perpendicular to both said vertical direction and said transverse direction.

20. The electrical connector as claimed in claim 13, wherein said LGA type contacting section is essentially located outside of the corresponding receiving hole and invades the neighboring receiving hole in a top view.

* * * * *